United States Patent [19]

Hong

[11] Patent Number: 4,812,616

[45] Date of Patent: Mar. 14, 1989

[54] APPARATUS FOR ELECTRICALLY HEATING SOFT ROLLER HAIR CURLERS

[76] Inventor: Andrew M. P. Hong, Room 7, 13/F, Block D, Hilton Plaza, Shatin, N.T. Kowloon, Hong Kong

[21] Appl. No.: 22,345

[22] Filed: Mar. 5, 1987

[51] Int. Cl.[4] ..... A45D 2/18; A45D 4/12; H05B 3/00

[52] U.S. Cl. ..... 219/222; 132/233; 219/242; 219/521; 219/530

[58] Field of Search ..... 219/222–226, 219/242, 385, 521, 367; 132/7, 9, 33 R, 37 R, 37 A

[56] References Cited

U.S. PATENT DOCUMENTS

| | | | |
|---|---|---|---|
| 793,229 | 6/1905 | Rolfe | 219/242 |
| 1,554,800 | 2/1925 | Dodge | 219/242 |
| 1,694,725 | 12/1928 | Tabb | 219/242 |
| 1,917,305 | 7/1933 | Johnson | 219/521 X |
| 1,927,959 | 9/1933 | Soloos | 219/367 |
| 2,562,821 | 7/1951 | Rothweiler | 219/521 |
| 3,946,196 | 3/1976 | Waters et al. | 219/242 X |
| 4,103,145 | 7/1978 | Oliveri | 219/222 |
| 4,166,472 | 9/1979 | Battaglia | 219/242 X |
| 4,419,568 | 12/1983 | Van Overloop | 219/222 X |
| 4,559,442 | 12/1985 | Graham | 219/521 X |
| 4,584,462 | 4/1986 | Morrison | 219/222 |
| 4,658,114 | 4/1987 | Hong | 219/222 |

*Primary Examiner*—Anthony Bartis
*Attorney, Agent, or Firm*—Alfred E. Miller

[57] ABSTRACT

A heater unit for heating flexible hair roller curlers includes two spaced pairs of side-by-side, elongated juxtaposed heat transmitting plates. The two plates of each pair are connected to each other in heat transmitting relationship to form a closed heat transmitting path and are so shaped and configured to form a plurality of individual hair curler receiving pockets therebetween. An electric heating element is positioned in the space between the two pairs of plates in heat conductive contact with the confronting plates thereof. The width of the plates is less than the length of the curlers so that the opposite ends thereof extend beyond the edges of the plates and are thus not heated thereby.

11 Claims, 3 Drawing Sheets

APPARATUS FOR ELECTRICALLY HEATING SOFT ROLLER HAIR CURLERS

The present invention relates to an apparatus for efficiently heating hair curling devices such as flexible rollers.

Arrangements are known for heating soft roller hair curlers in a casing for storing and transporting a multiplicity of elongated, cylindrical hair curlers. For example, my co-pending U.S. patent application Ser. No. 859,838, filed May 5, 1986, and now U.S. Pat. No. 4,658,114 discloses electrical resistance wires which are positioned between heat conductive plates and are wound in a sinuous pattern around rows of heating tubes for hair curlers in order to effect a concentrated heating pattern for the heating tubes. Furthermore, U.S. Pat. No. 4,298,787 to Barradas also shows heated tubes for hair curlers which are surrounded by flexible rope-like heating elements. Although the above-mentioned arrangements for heating roller-type hair curlers heat the hair curlers satisfactorily, a more effective heating arrangement is contemplated by the present invention in which PTC heater elements directly engage formed elongated plates having a series of arcuate complimentary sections, so that when the plates are secured together they form a plurality of curvilinear tube-like enclosures into which soft rubber hair curlers can be inserted, and removed after heating.

It is an object of the present invention to provide heating plates with complimentary curvilinear sections whereby the soft roller hair curlers are heated by contact with the plates at least approximately about 300 degrees of the cylindrical outer surface of each hair curler.

It is a further object of the present invention to provide a heater arrangement which is simple to fabricate and most effectively transmits heat to at least 300 degrees of the outer cylindrical surface of each soft roller hair curler.

It is another object of the present invention to provide at least one heating element which is cylindrical in configuration, and in which opposite external surfaces of said heating element fits in complimentary shaped recesses in abutting heat transmission plates.

It is a further object of the present invention to provide a heater arrangement for hair curler rollers which includes two juxtaposed heater plates in which one plate has curvilinear sections which conform to the outer curved surfaces of the rollers while the other plate exhibits a straight surface against which the heater element abuts for maximum heat transmission. The heater plates are connected so that they form a continuous heating path within which the roller type hair curlers are placed.

In order that the present invention may be more clearly understood, it will now be disclosed in greater detail with reference to the accompanying drawings, wherein.

Figure 1:
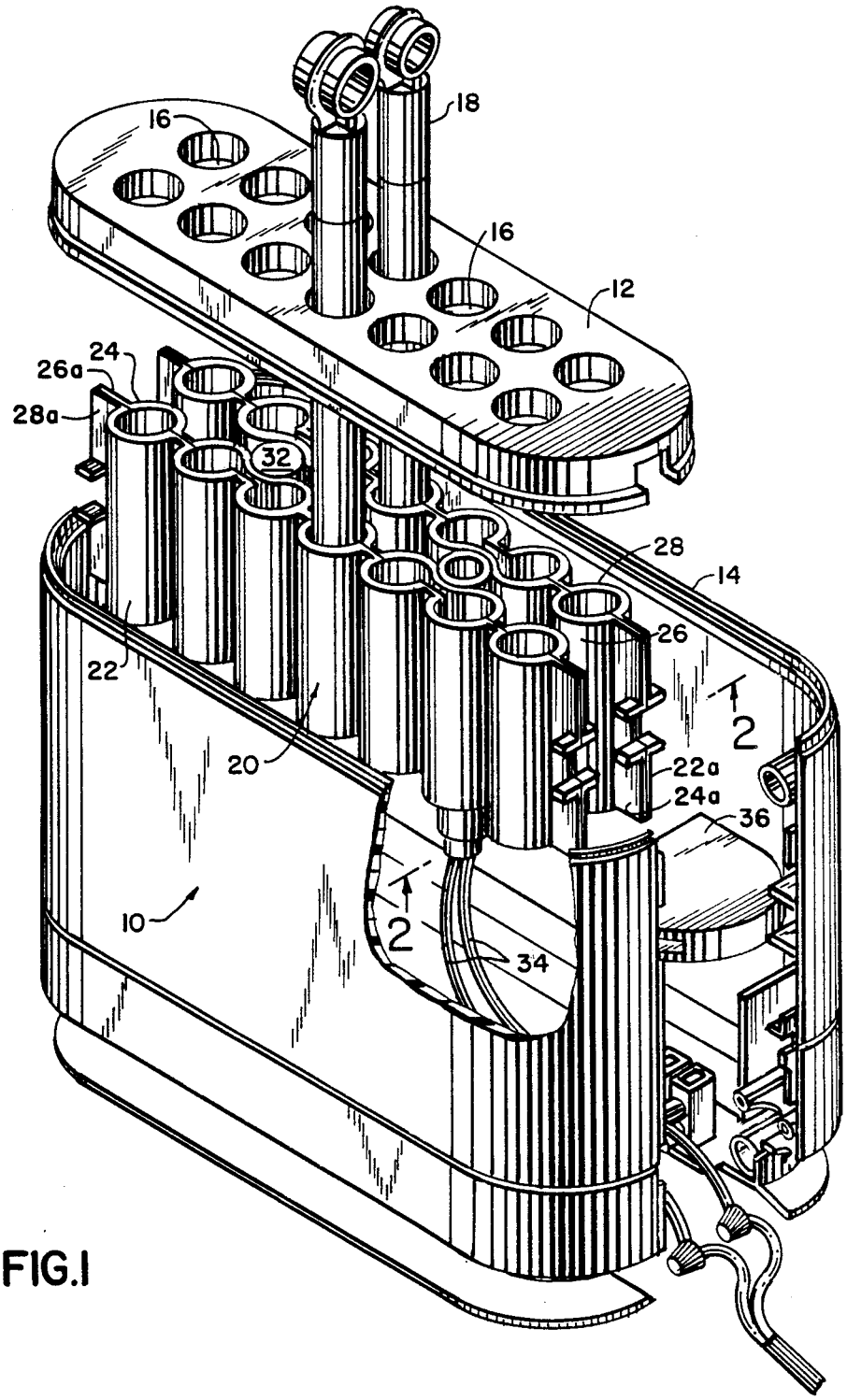
FIG. 1 is an exploded perspective view of the heater for roller hair curlers shown prior to assembly in a carrying case and constructed in accordance with the teachings of my present invention.

Referring to FIG. 1, a portable holder for a multiplicity of cylindrical shaped roller hair curlers is shown which incorporates an internal heater unit 20. The casing for the holder is referred to generally by the reference numeral 10 and may be fabricated of plastic, metal or any suitable material. A shelf 12 is supported on the upper lip 14 of the casing 10 and is provided with a plurality of round openings 16 into which roller hair curlers 18 are inserted into the aforementioned heating unit, referred to generally by reference numeral 20. This arrangement is also generally seen in my co-pending patent application Ser. No. 859,838, filed May 5, 1986.

Figure 3:
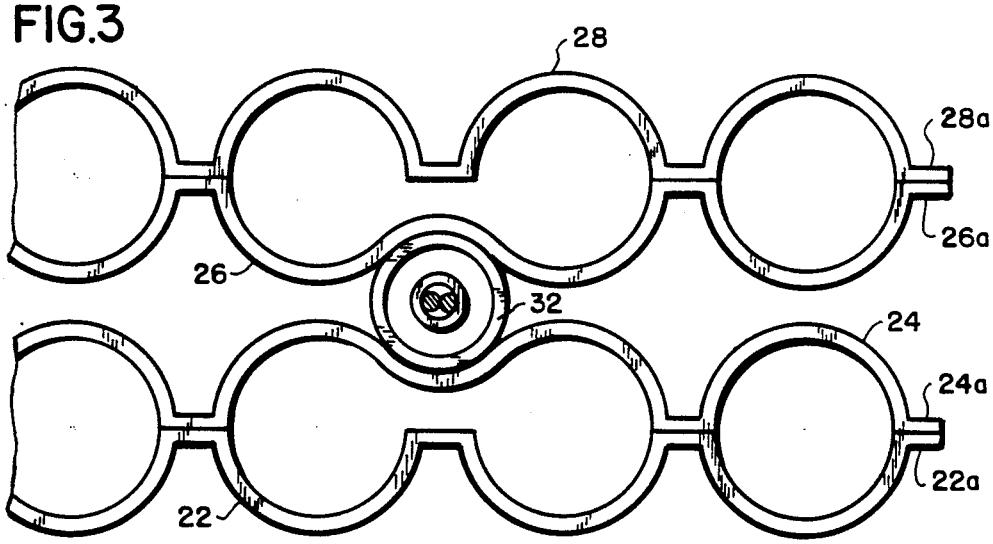
FIG. 3 is an enlarged, partial bottom plan view of the heater unit in assembled condition with the heater element in an upside down view abutting the heater plates.

The heating unit 20 involving the present invention constitutes two pairs of heating plates 22, 24 and 26, 28, which are connected together by end tabs **22*a*, 24*a*, and 26*a*, 28*a*, respectively. Located between the connected pairs of heating plates are heating heater elements 30 and 32 which abut both pairs of heating plates in heat-transmitting engagement therewith. It should be apparent from viewing FIGS. 1 and 3 that each pair of heating plates 22, 24 and 26, 28 form a closed path for transmitting heat along the entire circuit constituting heating plates 22 and 24 in one circuit and heating plates 26 and 28 in another circuit. Furthermore, each of the heating plates are provided with curved, semi-circular sections opposing each other and which are complimentary to thereby surround said cylindrical elongated hair curlers for about 300 degrees around an intermediate portion of each of the rollers circumference so that each of the rollers is uniformly heated about its circumference, thereby avoiding cold spots thereon. It will be observed from FIG. 1 of the drawings that the roller hair curlers 18 have a greater length than the width of the heating plates 20 so that the opposite ends of the hair curlers extend beyond the edges of the plates 20** and are not heated thereby, and are consequently cool to the touch.

As seen in FIG. 1, the heater elements are provided with lead wires 34 which are connected to an electric plug (not shown), which is suitable for insertion into an electric power source.

The heating plates are separated from the casing 10 by means of an insulator 36, thus preventing heat transfer to the casing instead of to the soft roller hair curlers.

Figure 2:
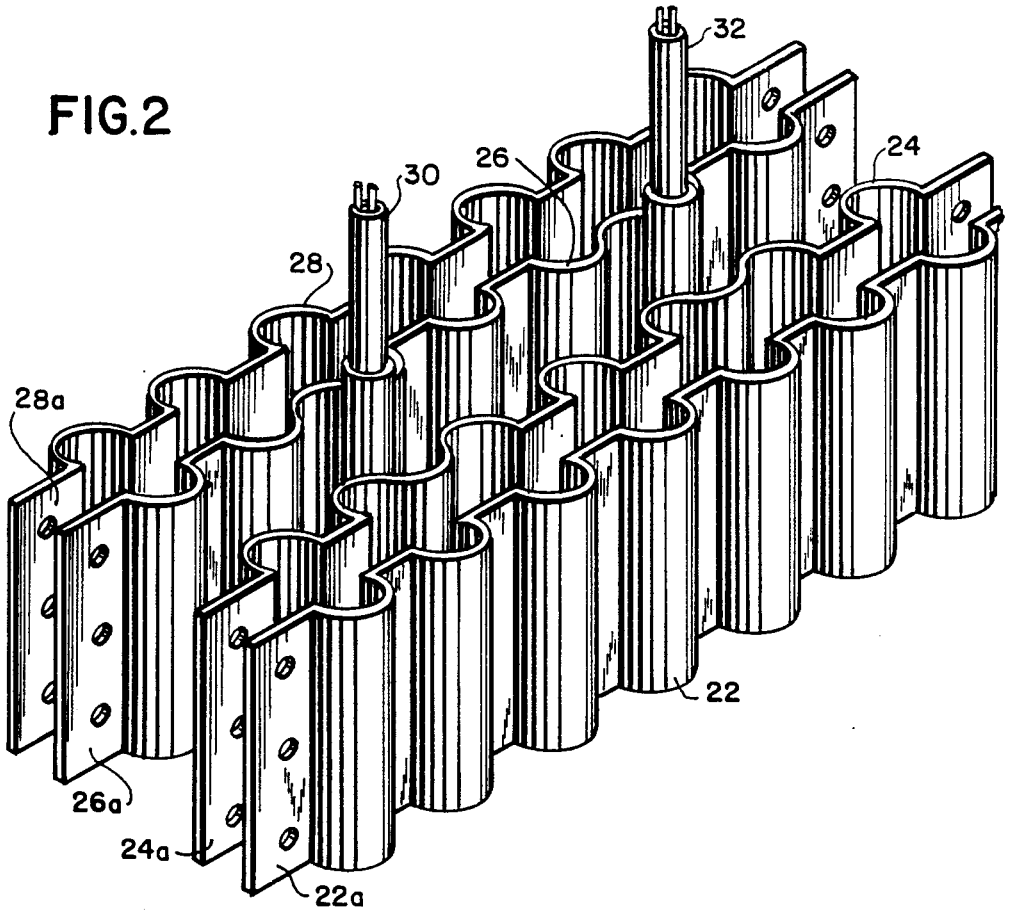
FIG. 2 is an exploded perspective view of the unassembled heater unit for roller hair curlers, from a bottom view.
Figure 4:
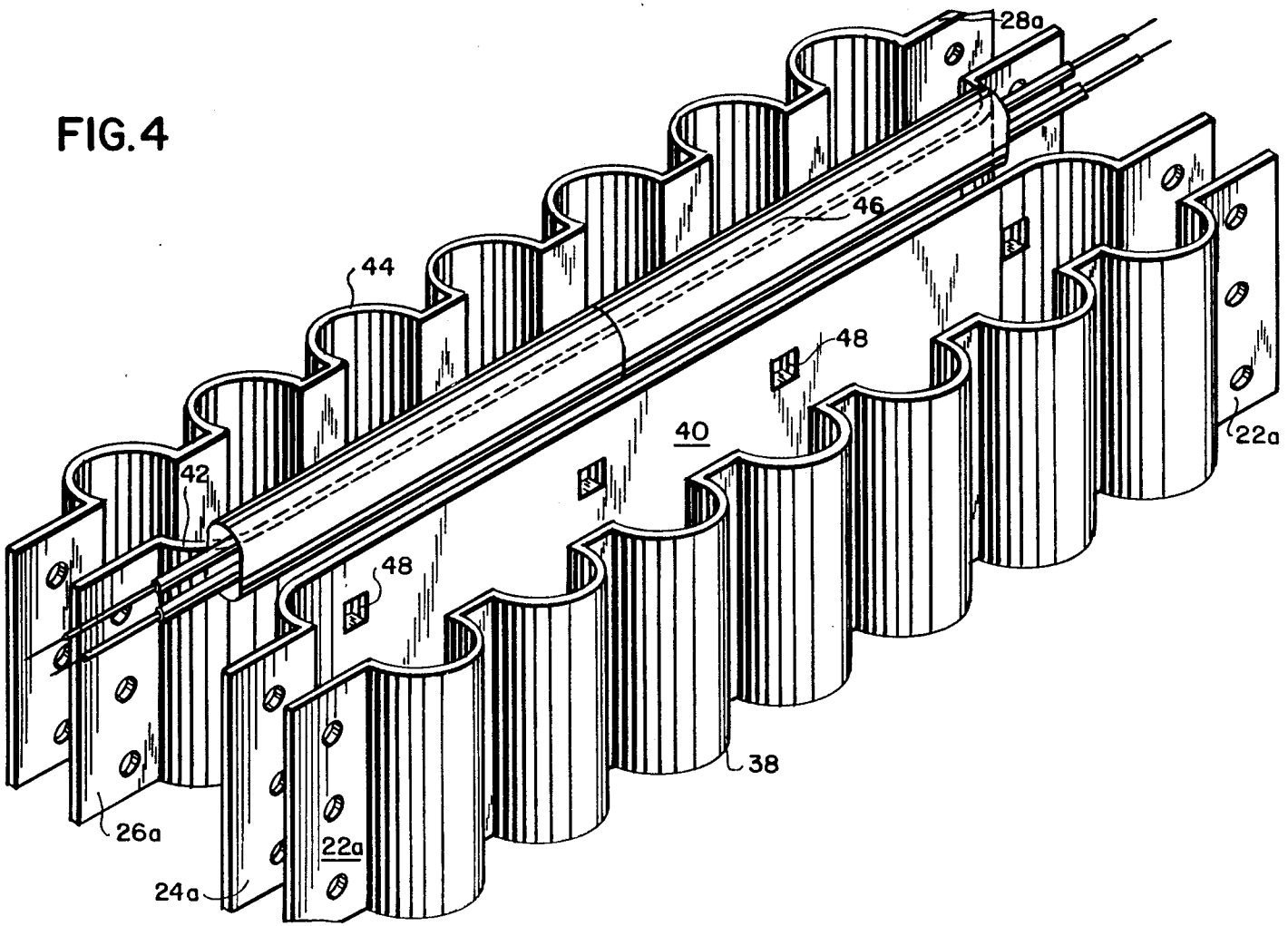
FIG. 4 is an exploded view of an alternate heater embodiment for roller hair curlers.

Referring particularly to the alternative embodiment shown in FIG. 4, the heating plates, 38, 40 and 42, 44 are somewhat similar to the plates shown in FIG. 2, with the exception that plates 40 and 42 have an elongated planer surface and do not include complimentary curved sections such as provided on the plates 38 and 44. Furthermore, the heating element is a single elongated member 46 which engages the adjacent planar sides of the heating plates 40 and 42 and is held in position on a series of projecting tabs 48 on plates 40 and 42. Consequently, the heating element engages the facing planar surfaces of heating plates 40 and 42, and thus transmits heat to these plates, as well as the closed circuits formed by pairs of plates 38, 40 and 42, 44. In the structure shown in FIG. 4 the elongated soft roller hair curlers are inserted in the spaces or pockets formed by the curved sections of the plates 38 and 40 and also engage the planer heating plates 40 and 42, respectively. In this manner, the hair curlers are heated on substantially all sides of its cylindrical surfaces thereof so that effective heating of the hair curlers can be achieved, thereby producing a better result for the user.

While the invention has been disclosed and described herein with reference to two embodiments of the invention, it should be apparent that variations and modifications may be made which will fall within the true spirit and scope of the invention as defined in the following claims:

I claim:

1. A heater for roller hair curlers comprising two spaced pairs of side-by-side elongated, juxtaposed heat transmitting plates, the two plates of each of said pairs being connected to each other in heat transmitting relationship to form a closed heat transmitting path and being so shaped and configured that a plurality of individual pockets are formed therebetween for receiving respective roller hair curlers to be heated, and at least one heating element positioned in the space between said two pairs of heat transmitting plates and in heat conductive engagement with the confronting plates thereof, the width of said plates being less than the length of the curlers so that the opposite ends of the roller hair curlers extend beyond the edges of said plates and are not heated thereby.

2. A heater for roller hair curlers as claimed in claim 1 wherein said pockets are curved to correspond to the outer surfaces of the roller hair curlers.

3. A heater for roller hair curlers as claimed in claim 2 wherein each of said curved pockets is adapted to surround the hair curler positioned therein on about 300 degrees of its circumference.

4. A heater for roller hair curlers as claimed in claim 3 wherein each of said at least one heating element is cylindrical in shape and wherein said confronting plates having complementary curvilinear surfaces into which each of said at least one heating element nests.

5. A heater for roller hair curlers as claimed in claim 1 wherein the plates of each of said pairs of plates are provided with opposed curved complimentary sections forming said pockets, and whereby the respective roller hair curlers adapted to be received in said pockets are substantially surrounded and engaged by said complimentary curved sections.

6. A heater for roller hair curlers as claimed in claim 1 further comprising a casing, and means of mounting said two pairs of plates in said casing including members at opposite ends of said plates for substantially preventing the transfer of heat from said plates to said casing.

7. A heater for roller hair curlers comprising two spaced side-by-side pairs of elongated, juxtaposed heat transmitting plates, the two plates of each of said pairs being connected to each other in heat transmitting relationship to form a closed heat transmitting path and being so configured and shaped that a plurality of individual pockets are formed therebetween for receiving respective hair curlers to be heated, and a heating element extending longitudinally in said space between said two pairs of plates and in heat conductive engagement with planar surfaces on the confronting plates of said two pairs of heat transmitting plates and wherein the width of said plates is less than the length of the curlers so that the opposite ends of the roller hair curlers extend beyond the edges of said plates and are not heated thereby.

8. A heater for roller hair curlers comprising two outer elongated, spaced heat transmitting plates and at least one central plate, each of said outer plates being juxtaposed with at the least one central plate, said plates being configured to define individual pockets between each of said at least one central plate for receiving respective hair curlers to be heated, each of said pockets being dimensioned and configured to receive one of the hair curlers, the two outer plates and at least one central plate being connected to each other to form closed heat transmitting paths, and at least one heating element mounted in heat exchange relationship to one of said plates for transmitting to said plates and thereby to the hair curlers.

9. A heater for hair curlers as set forth in claim 8 including two central vertical plates, and each said central plates together with one of said outer plates forming a pair of plates to thereby define said pockets.

10. A heater for roller hair curlers comprising two spaced outer heat transmitting plates, at least one juxtaposed intermediate heat transmitting plate positioned between said spaced outer plates in side-by-side relationship, at least one intermediate plate and the outer plates being connected to each other to form closed heat transmitting paths, heating means thermally connected to at least one of said plates for transmitting heat to all of said plates, and the outer plates being so shaped and configured that a plurality of pockets are formed between each of said outer plates and the confronting surface of the at least one intermediate plate to receive the hair curlers.

11. A heater for roller hair curlers as claimed in claim 10 wherein at least one of said shaped outer plates has curved sections each conforming in shape to at least a portion of the outer surface of an adjacent roller positioned in a respective pocket.

* * * * *